US005439174A

United States Patent [19]

Sweet

[11] Patent Number: 5,439,174

[45] Date of Patent: Aug. 8, 1995

[54] NUTATING SPRINKLER

[75] Inventor: Frederick J. Sweet, College Place, Wash.

[73] Assignee: Nelson Irrigation Corporation, Walla Walla, Wash.

[21] Appl. No.: 212,938

[22] Filed: Mar. 15, 1994

[51] Int. Cl.[6] ..... B05B 3/02

[52] U.S. Cl. ..... 239/222.17; 239/71

[58] Field of Search ..... 239/71, 74, 222.11, 239/222.17, 223

[56] References Cited

U.S. PATENT DOCUMENTS

| | | | |
|---|---|---|---|
| 2,639,191 | 5/1953 | Hruby, Jr. | 239/222.17 |
| 2,848,276 | 8/1958 | Clearman . | |
| 3,009,648 | 11/1961 | Hait . | |
| 3,034,728 | 5/1962 | Hruby, Jr. . | |
| 3,312,400 | 4/1967 | Clearman | 239/222.21 |
| 3,532,273 | 10/1970 | Siddall et al. | 239/222.17 |
| 4,073,438 | 2/1978 | Meyer | 239/237 |
| 4,290,557 | 9/1981 | Rosenberg | 239/222.21 |
| 4,398,666 | 8/1983 | Hunter | 239/222.13 |
| 4,487,368 | 12/1984 | Clearman | 239/222.17 |
| 4,660,766 | 4/1987 | Nelson et al. | 239/222.17 |
| 4,796,811 | 1/1989 | Davisson | 239/222.17 |
| 4,836,449 | 6/1989 | Hunter . | |
| 5,086,842 | 2/1992 | Cholet | 166/312 |
| 5,224,653 | 7/1993 | Nelson et al. | 239/222.17 |

FOREIGN PATENT DOCUMENTS 466099 10/1974 Australia ..... 239/222.17

OTHER PUBLICATIONS

Senninger brochure, "Nothing Wets Like the Wobbler®", date unknown.

*Primary Examiner*—Karen B. Merritt
*Attorney, Agent, or Firm*—Nixon & Vanderhye

[57] ABSTRACT

A sprinkler includes a body portion having a nozzle at one end and a cap assembly at an opposite end. The cap assembly is secured to the body portion supports a spray plate located downstream of the nozzle. The spray plate has a plurality of stream distributing grooves formed on one side thereof configured to cause the spray plate to rotate when struck by a stream emitted from the nozzle. A universal joint supports the spray plate in the cap assembly such that a center of the spray plate is caused to wobble in one direction of rotation when struck by a stream emitted from the nozzle. Respective sets of gear teeth on the cap assembly and the spray plate are arranged for progressive partial engagement in the one direction of rotation while the spray plate advances relative to the cap assembly in an opposite direction of rotation.

12 Claims, 2 Drawing Sheets

NUTATING SPRINKLER

BACKGROUND AND SUMMARY OF THE INVENTION

This invention relates to modular sprinkler devices and, more specifically, the invention relates to an improved sprinkler which incorporates a spray plate mounted for wobbling/rotating motion referred to herein as "nutation".

Moving irrigation systems, such as conventional pivot move (or center pivot) and lateral (or linear) move systems, are known to incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assemblies by means of drop tubes. The sprinkler heads typically incorporate rotatable stream distributors (also referred to as rotor plates or spray plates), fixed spray plates or bubbler devices.

When irrigating large areas of land with center pivot or linear systems, the sprinklers need to be spaced apart as tar as possible to minimize system hardware costs. To obtain an even distribution of the water at wide spacings requires sprinklers that simultaneously throw the water long distances and produce sprinkling patterns that are very even when overlapped with adjacent sprinklers. These two requirements are somewhat exclusive in that maximum radius of throw is achieved with concentrated streams of water shooting at a relatively high trajectory angle (approximately 20° up from horizontal); however, these streams tend to produce a "donut" shaped sprinkling pattern that does not overlap evenly.

It is the principal objective of this invention to solve the above problem by employing a multi-stream rotor or spray plate that wobbles as it rotates. Additionally, the rotor or spray plate is confined to move in a set motion through the use of a conical gear arrangement on the rotor or spray plate, and a mating gear arrangement on the stationary sprinkler cap assembly. This arrangement results in a controlled nutating movement of the spray plate which causes the water streams to rotate consistently and fill in the sprinkling pattern uniformly.

In an exemplary embodiment of the invention, the sprinkler itself includes generally a sprinkler body, a removable cap assembly, a nozzle and a connector-/adaptor. The cap assembly is modified to incorporate a rotor or spray plate which redirects a stream issuing from the fixed nozzle in a substantially radial direction by reason of a multi-groove configuration on a plate. These grooves are provided with combined radial and circumferential shape components (as opposed to only a radial component) so that the spray plate would otherwise be caused to rotate when struck by the stream emitted from the nozzle. In addition, the underside of the rotor or spray plate includes a central annular hub projecting from the underside of the plate. A shaft supports the spray plate at one end thereof and projects outwardly from the hub. The other end of the shaft receives a spherical ball which may be press fit or otherwise secured onto the shaft. The ball, in turn, is received within a complementary spherical ball retainer cage secured to the cap assembly. This universal type mounting arrangement permits universal wobbling movement of the shaft about an axis extending through the nozzle and the center of the cap assembly as the ball moves within the cage. The periphery of the underside of the spray plate is formed with a plurality of gear teeth which are designed to mesh with a plurality of gear teeth provided on the interior surface of the otherwise stationary cap assembly. In the preferred embodiment, sixteen gear teeth are provided on the cap assembly and fifteen gear teeth are provided on the underside of the spray plate.

The arrangement is such that the wobbling action causes the center of the rotor or spray plate to orbit in one direction of rotation about the aforementioned axis, and because of the wobbling action, it will be appreciated that the gear teeth on the rotor or spray plate will partially and progressively engage the gear teeth on the stationary cap assembly in that same direction. In other words, as the water stream from the nozzle travels through the grooves in the spray plate, it causes the rotor or spray plate to nutate about the ball center. As the center of the rotor or spray plate wobbles in, for example, a counter-clockwise direction of rotation, the perimeter of the rotor or spray plate is caused by the unequal number of gear teeth to advance stepwise (by one gear tooth per revolution) in a clockwise direction of rotation. This action will be described in greater detail hereinbelow. By so controlling the nutating movement of the spray plate, uncontrolled spinning of the plate is prevented and a uniformly even sprinkling pattern is achieved. To further enhance the ability of the sprinkler to provide a uniform sprinkling pattern, the groove configurations in the spray plate may be formed with varying surface trajectories and groove widths, shapes, etc.

Thus, in accordance with the broader aspects of the invention, there is provided a sprinkler body comprising a body portion having an inlet at one end and an outlet at an opposite end; a nozzle secured in the outlet; a cap assembly secured to the body and supporting a rotatable spinner plate located downstream of the outlet, the spinner plate having a plurality of stream distributing grooves formed on one side thereof configured to cause the spinner plate to rotate when struck by a stream emitted from the nozzle; the improvement comprising a universal joint for supporting the spinner plate in the cap assembly such that the spinner plate is caused to wobble as it rotates, and respective sets of gear teeth on the cap assembly and the spinner plate arranged for progressive partial engagement in the one direction, and wherein the respective sets of gear teeth are configured to cause the spray plate to advance relative to the cap assembly in an opposite direction of rotation.

In another aspect, the present invention relates to a sprinkler comprising a sprinkler body having an inlet end and an outlet end, the outlet end having a stream emitting orifice; a rotor plate mounted to a support downstream of the orifice, the rotor plate having a plurality of substantially radial grooves formed in one side of the plate, arranged to cause rotation of the plate when struck by a stream emitted from the orifice, the rotor plate having a shaft extending out of and away from an opposite side of the plate, a free end of the shaft having a ball element secured thereto, the ball element received in a ball retaining cage on the support.

It will be appreciated that the controlled rotating-/wobbling motion results in water being thrown from the rotor plate at different trajectory angles in a continuously changing manner, the motion controlled by the use of progressively partially meshing gear teeth to thereby cause the water streams to rotate consistently while filling in the sprinkling pattern evenly, thus avoiding the "donut" pattern described hereinabove.

Other objectives and advantages of the present invention will become apparent from the detailed description which follows.

DETAILED DESCRIPTION OF THE DRAWINGS

Figure 1:
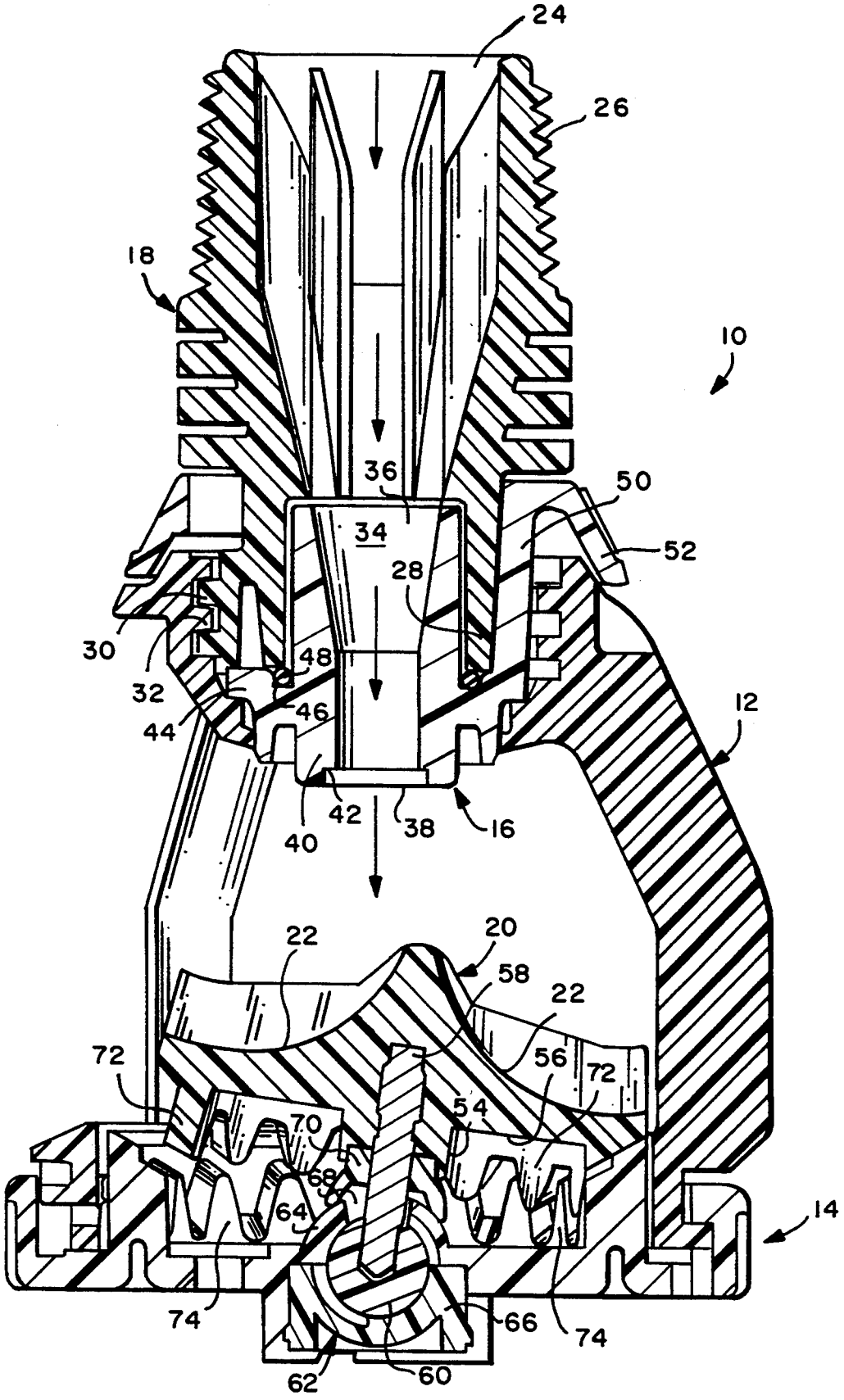
FIG. 1 is a cross section of a sprinkler in accordance with the invention.

With reference to FIG. 1, the nutating sprinkler 10 in accordance with this invention includes generally, a sprinkler body 12, a removable cap assembly 14, a nozzle 16, and a connector/adaptor 18. The cap assembly 14 is an easily removable, positive latching type cap of the type disclosed in commonly owned, application Ser. No. 08/113,046, incorporated herein by reference. The cap assembly 14 in this application is modified, however, to accommodate a rotor or spray plate 20 which redirects in a substantially radial direction, a stream issuing from the nozzle 16 by reason of the multi-groove configuration on the plate. In other words, the various grooves 22 formed in the spray plate, are configured to cause the spray plate to rotate about a wobbling axis in a controlled manner as will be described in more detail below. The configuration of the grooves to include both radial and circumferential components to cause rotation of a spray plate is by itself, well known.

The connector/adaptor 18 includes a male inlet end 24 provided with an external screw thread 26 adapted for connection to a pivot drop tube, supply pipe, hose or the like. The connector/adaptor 18 also includes a male outlet end 28 which is provided with an external discontinuous screw thread 30 adapted for threaded engagement with internal thread 32 in the inlet portion of the body 12.

The nozzle 16 includes a central, tubular portion 34 defining a flow passage having an inlet 36 at one end and a discharge orifice 38 at an opposite, outlet end 40. The nozzle flow passage tapers inwardly from the inlet end of the nozzle to a midpoint of the flow passage, where the diameter remains constant until it reaches the discharge orifice 38 which is defined by a slightly enlarged radial shoulder 42. The outlet end 40 includes an annular flange 44 formed with an annular groove 46 for receiving an O-ring 48. At the radially outermost end of the flange 44 of the nozzle 16, four circumferentially spaced webs or struts 50 are provided which are spaced radially outwardly of the tubular portion 34, and which extend substantially axially toward the inlet 36 of the nozzle. These webs or struts 50 support an annular identification band or ring 52 which lies radially outwardly of the webs or struts 50 and which also lies radially outwardly of the adaptor 18 so as to be easily visible. It will be understood that ring 52 may be color coded and/or contain indicia enabling the user to quickly identify the nozzle by size. The specific construction of the connector/adaptor 18 and nozzle 16 as illustrated here is disclosed in commonly owned, application Ser. No. 08/113,688, also incorporated herein by reference. The nozzle assembly 16 as shown is of one-piece plastic construction, it will be appreciated however (and as shown in the '688 application), that the nozzle itself may be brass or other suitable material, fitted within the plastic web and ring structure.

Returning to the rotor or spray plate 20, and as best seen in FIG. 1, the underside of the plate, i.e., that side opposite the side on which the water stream receiving grooves 22 are located, includes a central annular hub 54 projecting from the undersurface 56 of the plate. A metal (or plastic) shaft 58 supports the plate 20 at one end thereof, and in this regard, the rotor plate 20 may be molded in place about the one end of the shaft so as to project from the hub 54 in an axial direction. The opposite end of the shaft 58 receives a spherical ball 60 which may be plastic, brass or stainless steel. The ball 60 may be press fit or otherwise secured to the shaft 58 by any suitable means.

The ball 60 is received within a complementary, spherical retainer cage 62, a part of 64 of which is formed as an integral part of the cap assembly 14. A remaining portion 66 of the cage is press or snap fit within a recess provided in the cap. This arrangement permits mounting of the spray plate 20 to the cap assembly 14. The spherical cage 62 is formed with an opening 68 which permits universal wobbling movement of the shaft 58 about a vertical axis extending through the center of the nozzle 16 and the center of the cap assembly 14 as the ball 60 rotates within the cage 62. An annular cup seal 70 is secured between the hub 54 and the bearing cage 62. This seal may be formed of hard or resilient plastic material and prevents dirt or debris from entry into the bearing cage 62.

The periphery of the underside of spray plate 20 is formed with a plurality of conical gear teeth 72. These gear teeth 72 will be referred to as rotor gear teeth. At the same time, the interior surface of the stationary cap assembly 14 is formed with a series of conical gear teeth 74, which will be referred to as stator gear teeth, and which are designed to mesh with the rotor gear teeth 72.

In the preferred embodiment, sixteen (16) stator gear teeth are provided on the interior surface of the cap assembly 14, and fifteen (15) rotor gear teeth are provided on the underside of the spray plate 20. The consequence of this utilization of unequal numbers of gear teeth will be explained below.

Figure 4:
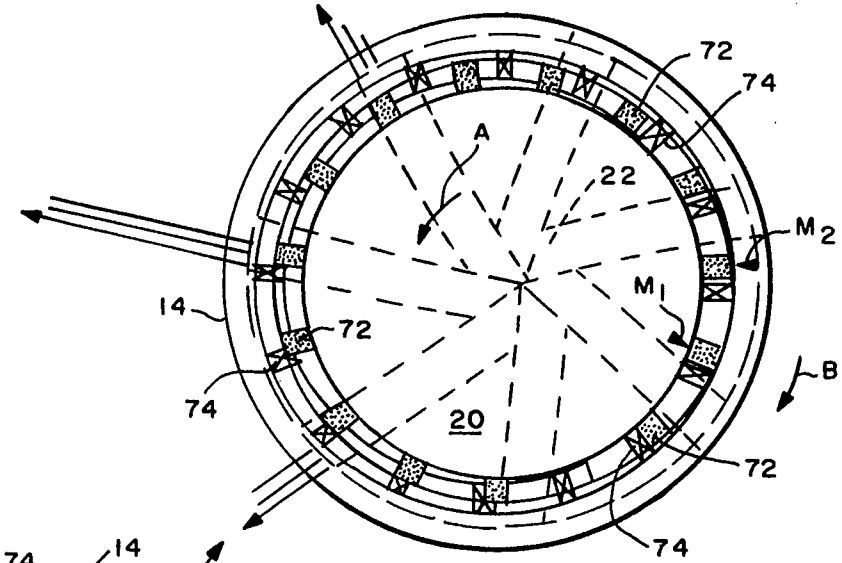
FIG. 4 is a schematic representation of the meshing engagement of gear teeth on the spray plate and cap assembly of the sprinkler of FIG. 1, but with the spray plate rotated one full cycle relative to FIG. 1.
Figure 3:
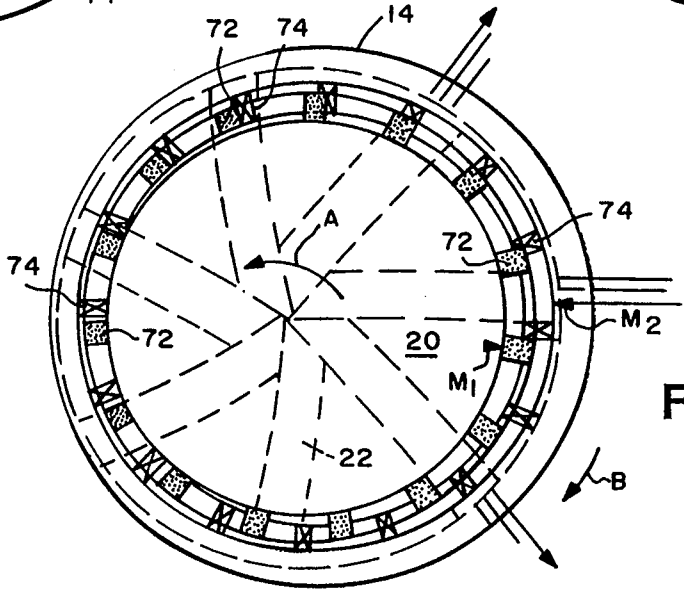
FIG. 3 is a schematic representation of the meshing engagement of gear teeth on the spinner plate and cap assembly of the sprinkler of FIG. 1, but with the spray plate rotated ½ cycle relative to FIG. 1.
Figure 2:
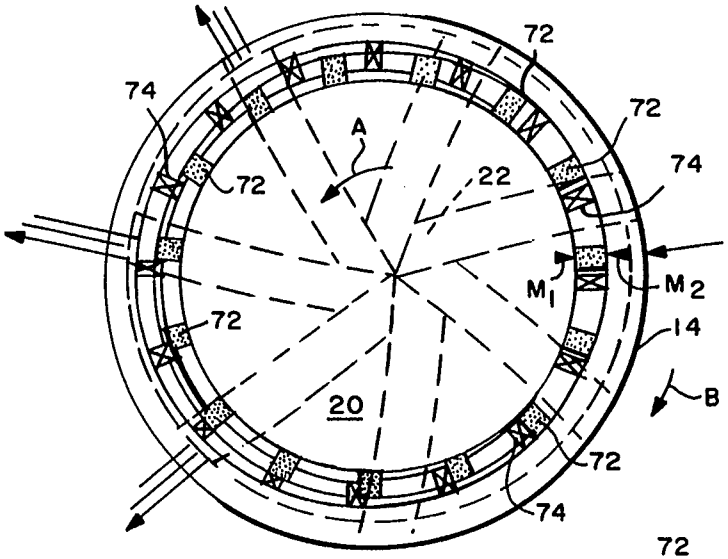
FIG. 2 is a schematic representation of the meshing engagement of gear teeth on the spray plate and cap assembly of the sprinkler of FIG. 1.

Because of the ability of the rotor or spray plate 20 to wobble about the aforementioned axis (also referred to as the reference axis) by reason of the universal mounting of the rotor plate 20, it will be appreciated that the stream emitted from nozzle 16 will strike the spray plate 20 constantly at an off center location and because of the multi-groove configuration within the rotor or spray plate 20, the latter will also rotate as it wobbles. With reference now to FIGS. 2–4, the manner in which the spray plate rotates and wobbles (i.e., nutates) will be described in detail.

FIG. 2 illustrates in schematic fashion, the position of the spray plate 20 just as illustrated in FIG. 1, leaning to the right (in FIG. 1) with the rotor gear teeth 72 engaged with the stator gear teeth 74 on the right hand side of both FIGS. 1 and 2. Because of the tilted orientation of the rotor or spray plate 20, the rotor gear teeth 72 on the left hand side of the plate as viewed in FIGS. 1 and 2 are raised out of engagement with the stator gear teeth 74.

For purposes of further explaining the manner in which the spray plate 20 rotates and wobbles, note the position of the index marks M1 and M2 in FIG. 2. M1 is located on the spray plate 20 while M2 is located on the stationary cap assembly 14. In the position shown in FIG. 2, the stream will be emitted generally from the left hand side of the plate as indicated by the flow arrows. On the side opposite the emitting streams (i.e., the right side as viewed in FIGS. 1 and 2), the rotor gear teeth 72 of the spray plate 20 and the stator teeth 74 of the stationary cap assembly 14 are fully engaged. As already explained, the water stream emitted from the nozzle 16 travels through the grooves 22 in the spray plate 20, causing the spray plate to nutate (rotate and wobble) about the ball center. As the spray plate 20 wobbles (causing progressive partial meshing engagement of the rotor gear teeth 72 with the stator gear teeth 74), the center of the plate 20 orbits about the reference axis in a counterclockwise direction of rotation indicated by arrow A, the perimeter of the spray plate 20 is forced by the unequal number of gear teeth 72, 74 to step advance in a clockwise direction of rotation indicated by arrow B. More specifically, as the emitting streams rotate around, they cause the spray plate 20 to step around the stationary gear teeth 74 in the cap assembly. In this particular design, because the cap 14 has sixteen (16) gear teeth and the spray plate 20 has fifteen (15) teeth, the spray plate 20 will advance one gear tooth per cycle of itself which is equal to $360° \div 15 = 24°$ per cycle. Since there are seven grooves 22 equally spaced on the spray plate, and since the spray plate 20 turns 24° per cycle, the emitting streams will occur at every 3.4° ($24° \div 7$). After sixteen cycles or nutations of the spray plate 20, an emitting stream will have occurred at every 3.4° of revolution. This motion, combined with excessive backlash designed into the gears for a slight degree of randomness, will very evenly fill in the sprinkling pattern.

It will be appreciated, of course, that for added variation, the number of grooves 22 may be varied, as well as the shape and contour of individual grooves relative to other grooves. In other words, individual groove widths and shapes as well as groove surface contours (trajectories) may be varied individually. The number of teeth 72, 74 on the spray plate and the cap, respectively, may also be varied.

With the above in mind, and turning to FIG. 3, the index marks $M_1$ and $M_2$ have moved relative to one another following a $\frac{1}{2}$ cycle rotation of the spray plate 20 relative to the position shown in FIGS. 1 and 2. Note that in FIG. 3, meshing engagement between rotor teeth 72 and stator teeth 74 occurs on the left hand side of the Figure while the stream is emitted generally from grooves 22 on the right hand side of the Figure. FIG. 4 illustrates a position after one full cycle of the spray plate 20 vis-a-vis the position shown in FIGS. 1 and 2, with the partial meshing engagement again occurring on the right hand side of the Figure (and the streams emitting generally from the opposite or left hand side of the Figure).

This continuous motion is thus controlled by the progressive partial meshing engagement of the gear teeth 72, 74 so that uncontrolled spinning of the spray plate 20 is prevented. At the same time, the wobbling action combined with the stepwise advance of the gear teeth 74 on the spray plate 20 insure a continuously changing sprinkling pattern which uniformly fills in the sprinkling area.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a sprinkler comprising a body portion having a nozzle at one end and a cap assembly at an opposite end; said cap assembly secured to said body portion and supporting a spray plate located downstream of said nozzle, said spray plate having a plurality of stream distributing grooves formed on one side thereof configured to cause said spray plate to rotate when struck by a stream emitted from said nozzle; the improvement comprising a universal joint for supporting said spray plate in said cap assembly such that a center of said spray plate is caused to wobble in one direction of rotation; and respective sets of gear teeth on said cap assembly and said spray plate arranged for progressive partial engagement in said one direction, and wherein said respective sets of gear teeth are configured to cause said spray plate to advance relative to said cap assembly in an opposite direction of rotation.

2. The sprinkler of claim 1 wherein gear teeth formed in said cap assembly are not equal in number with gear teeth formed in said spray plate.

3. The sprinkler of claim 2 wherein said gear teeth formed in said cap assembly exceed tile number of gear teeth formed in said spray plate by at least one.

4. The sprinkler of claim 3 wherein 16 gear teeth are formed on said cap assembly.

5. The sprinkler of claim 1 wherein said gear teeth formed in said spray plate are formed in an annular array, projecting from a side of the spray plate opposite said one side.

6. The sprinkler of claim 5 wherein said gear teeth formed in said cap assembly are formed in an annular array on an underside of said cap assembly.

7. The sprinkler of claim 1 wherein said universal joint comprises a shaft projecting from said spray plate, an end of the shaft remote from the spray plate mounting a ball element; and a ball retaining cage on an underside of said cap assembly, wherein said ball element is received within said ball retaining cage.

8. The sprinkler of claim 7 and further including a seal mounted on said shaft between the opposite ends of said shaft, and engaging said ball retaining cage.

9. The sprinkler of claim 7 wherein said ball retaining cage is formed partially integrally with said cap assembly; and partially by a separate member mounted within said cap assembly.

10. A sprinkler comprising:

a sprinkler body mounting a nozzle at one end and a support at an opposite end, said nozzle having a stream emitting orifice; a spray plate mounted to said support downstream of said stream emitting orifice, said spray plate having a plurality of substantially radial grooves formed in one side of said spray plate, said spray plate having a shaft extending out of and away from an opposite side of said plate, a free end of said shaft having a ball element secured thereto, said ball element received in a ball retaining cage on said support; and further including a seal mounted on said shaft between the opposite ends of said shaft, and engaging said ball retaining cage.

11. A sprinkler comprising:

a sprinkler body mounting a nozzle at one end and a support at an opposite end, said nozzle having a stream emitting orifice; a spray plate mounted to said support downstream of said stream emitting orifice, said spray plate having a plurality of substantially radial grooves formed in one side of said spray plate, said spray plate having a shaft extending out of and away from an opposite side of said plate, a free end of said shaft having a ball element secured thereto, said ball element received in a ball retaining cage on said support; wherein an adaptor is secured to an inlet end of said sprinkler body, and wherein said nozzle is sandwiched between said adaptor and said sprinkler body.

12. A sprinkler comprising:

a sprinkler body mounting a nozzle at one end and a support at an opposite end, said nozzle having a stream emitting orifice; a spray plate mounted to said support downstream of said stream emitting orifice, said spray plate having a plurality of substantially radial grooves formed in one side of said spray plate, said spray plate having a shaft extending out of and away from an opposite side of said plate, a free end of said shaft having a ball element secured thereto, said ball element received in a ball retaining cage on said support; wherein said shaft is adapted to nutate relative to a reference axis as a stream emitted from said orifice strikes said spray plate; and further wherein said opposite side of said spray plate and said support are formed with cooperating gear teeth arranged and configured to partially progressively mesh in one direction of rotation while said spray plate advances relative to said support in stepwise fashion in a direction of rotation opposite said one direction.

* * * * *